United States Patent [19]

Martin et al.

[11] 3,976,221

[45] Aug. 24, 1976

[54] CARBONATOR AND DISPENSER FOR CARBONATED LIQUID OR THE LIKE

[75] Inventors: Richard E. Martin, Willoughby; Anthony M. Gildone, Euclid, both of Ohio

[73] Assignee: GMF Inc., Cleveland, Ohio

[22] Filed: Sept. 11, 1975

[21] Appl. No.: 612,271

Related U.S. Application Data

[63] Continuation-in-part of Ser. No. 484,122, June 28, 1974, Pat. No. 3,927,801.

[52] U.S. Cl. ..... 222/61; 138/40; 222/564

[51] Int. Cl.[2] ..... B67D 5/00; F15D 1/02

[58] Field of Search ..... 222/564, 61; 239/589, 239/590; 138/39, 40

[56] References Cited

UNITED STATES PATENTS 2,210,634 8/1940 Rice ..... 222/564 X

*Primary Examiner*—Allen N. Knowles
*Assistant Examiner*—Hadd Lane

[57] ABSTRACT

An improved carbonated LIQUID dispenser has a passageway between the carbonated LIQUID and an outlet valve. A foam inhibiting portion of the passageway progressively decreases, then increases, then decreases, and finally increases again in flow area. Preferably the flow inhibiting portion of the passage comprises a chamber containing two spherical bodies which are fixed in the chamber and which are unequal in diameter.

10 Claims, 8 Drawing Figures

CARBONATOR AND DISPENSER FOR CARBONATED LIQUID OR THE LIKE

PRIOR APPLICATION

The present application is a continuation-in-part application of Ser. No. 484,122, filed June 28, 1974, now U.S. Pat. No. 3,927,801.

BACKGROUND OF THE INVENTION

This invention relates to a dispenser for a carbonated LIQUID or the like and in particular it relates to reduction of foaming in the dispensing of such a liquid. See, for example, U.S. Pat. No. 2,210,634.

Dispensers for carbonated liquids are known, and one such known type comprises a device complete with a means for mounting a carbon dioxide cartridge and the necessary valving, the device being adapted for mounting directly onto a container such as a carbonated liquid container for delivering the liquid. See, for example, U.S. Pat. No. 3,039,661. However, these and other known carbonated liquid dispensing arrangements have had certain problems or disadvantages. Firstly, when dispensing any liquid such as a carbonated liquid under pressure with a gaseous medium thereabove, there is a tendency for the liquid to foam as it is dispensed. Secondly, there is the problem of keeping the dispenser system in a highly sanitary condition. These problems are related since the basic approach to eliminating or reducing foaming, as described for example in U.S. Pat. Nos. 3,252,633 and 3,307,751 involve providing a reduced cross-section portion within the dispensing passageway, but this necessarily involves providing very small clearances for the liquid which are difficult to clean, thereby making it more difficult to provide maximum sanitary conditions therein.

Also, while previously known restricting arrangements for carbonated liquid passageways or the like have been satisfactory to some extent for accomplishing their purpose, they have not been completely satisfactory for all purposes so that there remains a continuing need for new and improved arrangements for reducing or eliminating foaming in the dispensing of a carbonated liquid or the like.

SUMMARY OF THE INVENTION

Thus, it is a purpose of the present invention to provide a new and improved dispensing arrangement for carbonated liquids or the like which overcomes the problems and disadvantages in previously known arrangements. This purpose of the present invention is achieved by providing a carbonated liquid dispenser having a passageway from the reservoir of liquid to an outlet valve and providing in this passageway a portion having a restricting means therein wherein the flow area progressively decreases over a finite length of the passageway after which the flow area increases again to the outlet valve.

In accordance with a preferred embodiment of the invention, the restricting means may comprise two balls located in the passageway wherein the passageway decreases in flow area from the upstream point of the balls to the diametral plane extending across the passageway. The arrangement may include a cap having a liquid passageway therethrough and having slots at one end thereof and wherein one ball rests against this end. In this manner the liquid leaving the reservoir passes through the cap and through the slots and around the balls. Not only has this arrangement been found to be very satisfactory for reducing or eliminating foaming, but in addition, it is highly advantageous for maintaining sanitary conditions since the cap and hence also the ball can be removed for cleaning of the enlarged part of the passageway in which the cap and balls are normally mounted.

In a preferred form of the invention, a plurality of fixed balls are advantageously provided, the upstream end of one ball being retained longitudinally by engagement with the end of the cap and the opposite end of the other ball being restrained longitudinally to prevent lateral and longitudinal movement of the balls.

Thus, it is an object of this invention to provide a new and improved carbonated liquid dispenser which minimizes foaming upon dispensing of a liquid.

It is another object of this invention to provide, in a carbonated liquid dispenser, a means for eliminating or reducing foaming which includes a portion in which the flow area which sequentially and repetitively decreases and increases in size.

BRIEF DESCRIPTION OF THE DRAWINGS

The foregoing and other objects and features of the present invention will become more apparent upon a consideration of the following description taken in connection with the accompanying drawings wherein.

DETAILED DESCRIPTION OF PREFERRED EMBODIMENTS

Figure 1:
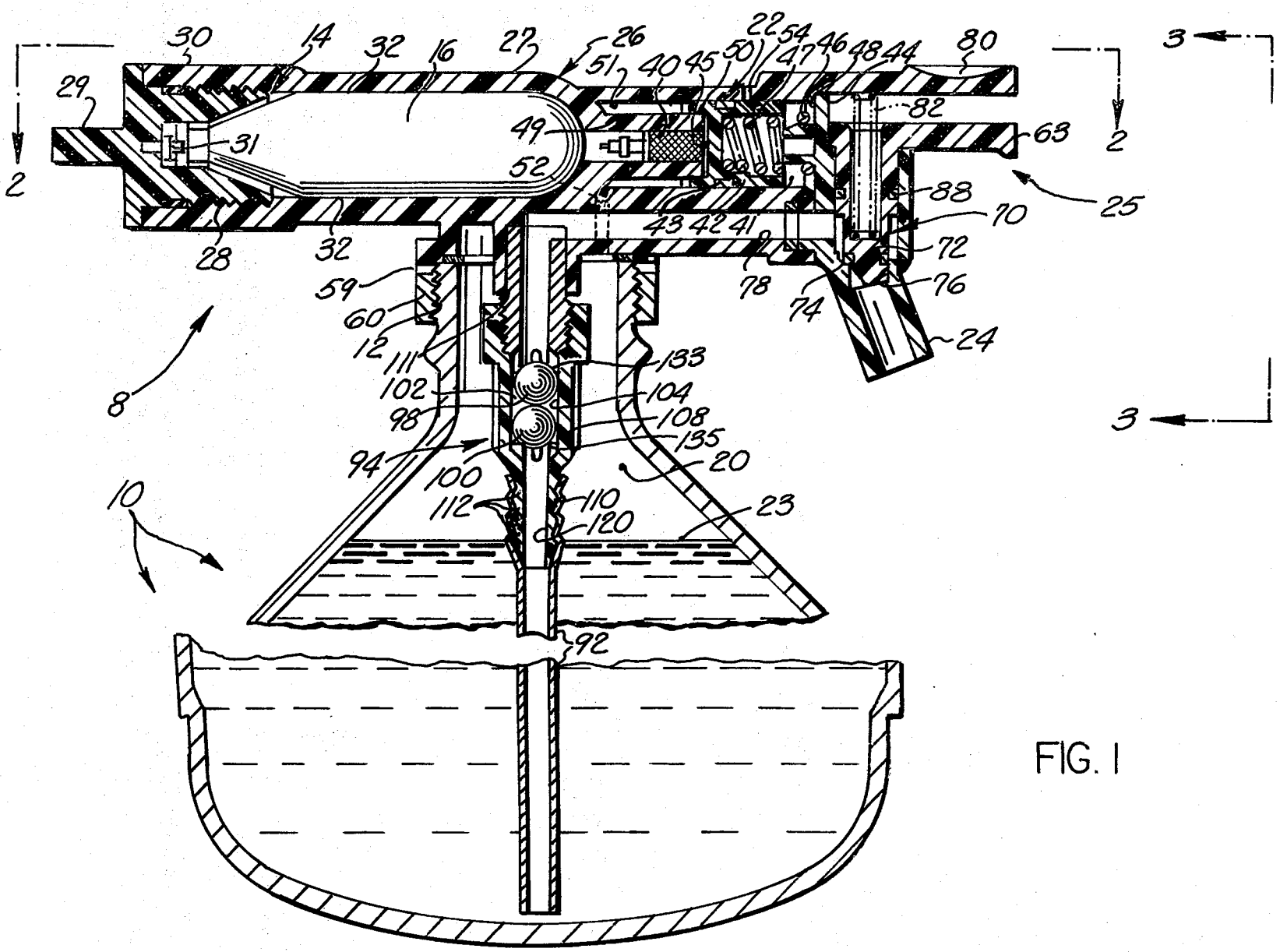
FIG. 1 is a sectional view of a dispenser valve assembly constructed in accordance with the present invention in association with a container of carbonated liquid.

A dispenser valve assembly 8 constructed in accordance with the present invention is shown in FIG. 1 in association with a liquid container 10 which may, for example, be a disposable glass or plastic carbonated liquid container. The container 10 has a mouth 12 with a threaded exterior to which the dispenser valve assembly 8 is releasably connected. The dispenser valve assembly 8 is self-contained in the sense that it includes a pressure chamber 14 for holding a replaceable carbon dioxide cartridge 16. Gas is ported from the pressure chamber 14 to the interior 20 of the container 10 through a pressure responsive valve assembly 22. Carbonated liquid 23 is discharged through a spout 24 upon actuation of a main control valve 25.

A plastic body 26 of the valve assembly 8 includes a generally cylindrical wall 27 partially defining the chamber 14 and terminating in an internally threaded opening 28. A threaded end cap 29 is received in the opening 28 and includes an O-ring 30 for sealing the cavity and also a pin 31 adapted to pierce the cartridge 16 to release carbon dioxide as the end cap 29 is screwed into the opening 28.

The carbon dioxide, having been released from cartridge 16 flows to the pressure responsive valve assembly 22 through clearance 32 formed between cartridge 16 and the wall 27 and extending lengthwise of the chamber 14. The carbon dioxide flows to the container 10 through the pressure responsive valve assembly 22. The pressure responsive valve assembly 22 includes a valve 40 mounted in the body 26 and is of the type used in automobile tires and hence it will be referred to hereinafter as a tire valve. When a central stem at the right end (as viewed in FIG. 1) of the tire valve 40 is engaged and moved leftwardly, the valve opens. To the right (as viewed in FIG. 1) of the tire valve 40 is a cavity 41 receiving therein a piston 42 having at the bottom thereof a projection 45 for engaging the stem of the tire valve 40 to open the tire valve when the piston 42 moves leftwardly. The piston 42 includes an O-ring seal 43. The cavity 41 extends rightwardly to an opening 48 which is blocked by an end cap 44. A central boss 46 extends leftwardly from the cap 44 and receives thereon a spring 47 which at its other end engages the piston 42 for urging the same leftwardly.

The piston 42 cooperates with a cylindrical wall 49 enclosing the tire valve 40 to provide an orifice through which carbon dioxide can pass under pressure when the tire valve 40 is opened by the projection 45 on the piston. To form the orifice, the piston 42 is provided with a cylindrical skirt 50 which extends into a telescopic relationship with the cylindrical wall 49. There is a small space between the inner surface of the cylindrical piston skirt 50 and the outer surface of the wall 49 to form a circular orifice so that carbon dioxide can flow from the clearance 32 in the pressure chamber 14 through the open tire valve 40 to a cylindrical chamber 51 surrounding the wall 49. The annular chamber 51 is connected in fluid communication with the interior 20 of the container 10 through internal passage 52. Therefore, upon operation of the tire valve 40 to the opened condition carbon dioxide can flow from the pressure chamber 14 through the annular orifice formed between the piston skirt 50 and cylindrical wall 49 to the chamber 51 and from the chamber 51 through the passage 52 to the interior of the container 10.

As the gas pressure in the interior of the container 10 increases, the pressure in the chamber 51 also increases. The fluid pressure in the chamber 51 urges the piston 42 toward the right (as viewed in FIG. 1) against the influence of the biasing spring 47. As the piston 42 moves toward the right, the projection 45 moves away from the tire valve 40. When a predetermined pressure sufficient to keep the carbon dioxide in the liquid 23 is present in the chamber 20, the fluid pressure force against the piston 42 will have moved the piston away from the tire valve 40 through a distance so that the tire valve closes to block the flow of further carbon dioxide from the chamber 14 to the container 10.

If the container 10 is utilized in a relatively hot environment, the pressure in the interior chamber 20 of the container 10 may become excessive. To prevent the accumulation of excessive fluid pressures in the container 10, the piston 42 is movable toward the right through a distance sufficient to vent the chamber 51 to the atmosphere through a passage 54. Thus, once the O-ring seal 43 has moved to the right of the vent passage 54, carbon dioxide can flow from the chamber 51 around the exterior of the piston skirt 50 to the atmosphere through the passage 54.

If the container 10 is turned upside down, the liquid 23 may tend to flow from the container 10 through passage 52 to the chamber 51. To prevent the liquid from clogging the tire valve 40 and otherwise interfering with its operation, the orifice between the piston skirt 50 and cylindrical wall 49 has a relatively small radial clearance so that the liquid cannot pass through the orifice. However, the radial clearance of the orifice is sufficient to enable carbon dioxide gas to pass through the orifice to the chamber 51.

When the pressure in container 10 is sufficiently low so that more carbon dioxide is required, this low pressure is communicated through passage 52 to the chamber 51. The reduction in pressure in the chamber 51 enables the spring 47 to move the piston 42 leftwardly (as viewed in FIG. 1) so that the projection 45 opens the tire valve 40, permitting carbon dioxide to pass through the valve 40, chamber 51 and passage 52 to the container 10. When a desired pressure has then been reached, the piston 42 will move rightwardly against the force of spring 47, thereby enabling the valve 40 to close. If the pressure within the container 10 and hence the cavity 51 increases beyond a predetermined pressure, the piston 42 moves rightwardly until it abuts the cap 44 and vent passage 54 is opened to reduce the pressure in the chamber 51 and the interior of the container 10.

The pressure responsive valve assembly 22 can be adjusted for any pressure suitable for operation and safety, such as, for example, 20 to 35 p.s.i. Vent passage 54 serves as an additional safety feature to prevent excessive pressures from building up in container 10. The dispenser valve assembly 8 may also be constructed with a fail-safe feature by adjusting handle 63 and spring 82 to open at a pressure higher than that required to open vent passage 54, allowing the carbonated liquid and excess pressure to escape. Thus, for example, valve assembly 22 can be set at 30 p.s.i., vent passage 54 at 50 p.s.i., and handle 63 at 69 p.s.i. for a completely safe operation of the dispenser valve. Another safety feature involves the provision of a small hole or holes 59 in sleeve 60 so that when dispenser 8 is being removed from container 10, the interior pressure will be released before the dispenser is completely free from the container. A further safety feature involves the positioning of the gas exit of cartridge 16 away from valve assembly 22, requiring the gas to travel back along the cartridge 16. The resulting gas pressure binds threaded end cap 29 against threaded opening 28 until cartridge 16 is substantially exhausted, thus preventing any unsafe removal of cartridge 16. Positioning cartridge 16 away from the valve assembly also has the advantage of preventing any freezing.

The dispenser valve assembly 8 further includes a central downwardly extending and internally threaded sleeve 60 which engages the external threads on the neck of the container 10. When the container 10 has been emptied, the dispenser valve assembly 8 can be unscrewed and connected with another container. Of course, the carbon dioxide cartridge 16 may have to be replaced at this time.

Figure 3:
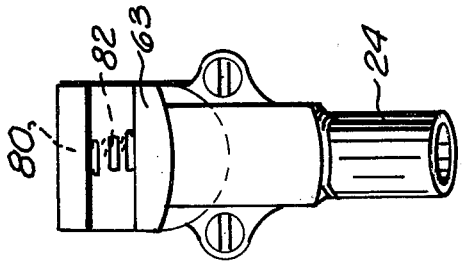
FIG. 3 is a side elevational view, taken generally along the line 3—3 of FIG. 1 illustrating the relationship between a discharge spout and a manually actuatable valve handle.

When the liquid 23 is to be discharged from the container 10, a flow control valve 70 is actuated to enable fluid to flow through the spout 24 (FIGS. 1 and 3). The flow control valve 70 includes a generally cylindrical valve body 72 which is formed in an annular recess holding an O-ring seal 74. When the valve assembly 70 is in the closed condition illustrated in FIG. 1, the O-ring 74 sealingly engages a frustro-conical valve seat 76 to block the flow of the carbonated beverage from the passage 78 to the spout 24.

Figure 2:
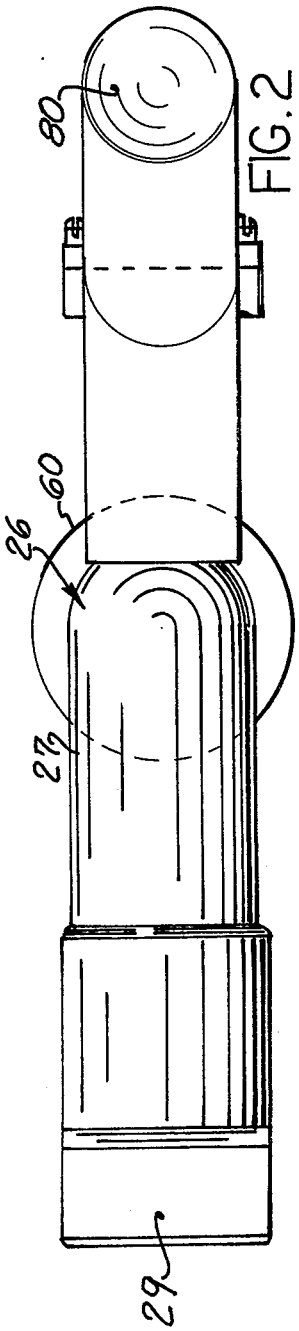
FIG. 2 is a top plan view, taken generally along the line 2—2 of FIG. 1, further illustrating the construction of the dispenser valve assembly.

When the valve assembly 70 is to be opened to enable carbonated liquid to be discharged through the spout 24, a handle 63 is moved upwardly (as viewed in FIGS. 1 and 3) toward a fixed member 80 by squeezing them together. The member 80 is integrally molded with the wall 27 (see FIG. 2). As the handle 63 moves upwardly, the valve body 72, which is integrally molded with the plastic handle 63, is moved upwardly against the influence of a valve spring 82. The valve spring 82 is received within a cylindrical cavity in the valve member 72 and extends upwardly into abutting engagement with the fixed member 80. A second O-ring seal 88 blocks fluid flow upwardly along the valve body 72 to prevent leakage around the handle 63.

When the valve 70 has been opened, the relatively high pressure of the carbon dioxide within the interior 20 of the container 10 causes the carbonated liquid to be forced upwardly through a cylindrical tube 92 to a foam inhibiting device 94. The carbonated liquid flows from the foam inhibiting device 94 to the main fluid passage 78. When the valve body 72 has been raised upwardly to the open condition, the carbonated liquid can flow from the main passage 78 to the spout 24. Of course, a glass or other suitable receptacle is placed adjacent to the spout 24 before the valve 70 is opened.

In accordance with a feature of the present invention, the foam inhibiting device 94 is effective to retard the formation of foam in the glass as the carbonated liquid is discharged from the spout 24.

The foam inhibiting device 94 includes a pair of balls 98 and 100 of teflon or other suitable material (see FIG. 4) which are fixedly disposed in a generally cylindrical chamber 102. The chamber 102 is defined by a generally cylindrical plastic wall portion 104 of threaded end cap 108 which has a downwardly projecting tubular connector portion 110 (FIG. 1). The tubular connector portion 110 is provided with a plurality of annular ribs 112 which engage a flexible upper end portion of the tube 92. End cap 108 is threadedly engaged to insert 111 which is in turn connected to dispenser body 26.

Figure 6:
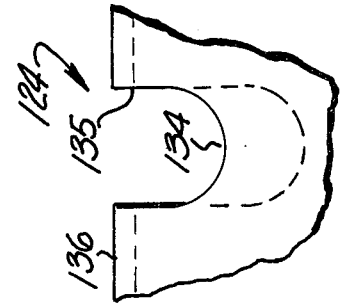
FIG. 6 is a sectional view, taken generally along the line 6—6 of FIG. 5, illustrating the configuration of slots formed in the bottom wall of the chamber.
Figure 5:
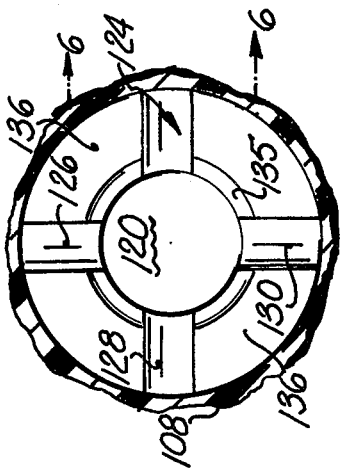
FIG. 5 is a plan view, taken generally along the line 5—5 of FIG. 4, illustrating the construction of a bottom wall of a chamber of the foam inhibiting device.
Figure 4:
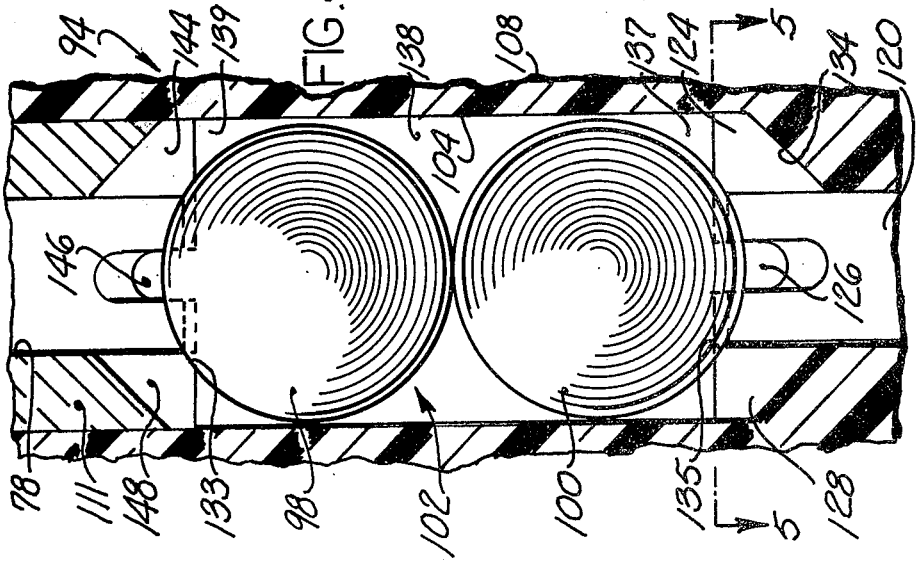
FIG. 4 is an enlarged sectional view illustrating the construction of a foam inhibiting device.

The carbonated liquid enters the chamber 102 through a generally cylindrical passage 120 formed in the tubular connector portion 110. The lower end of plastic wall portion 104 is provided with a plurality of identical radially extending grooves or slots 124, 126, 128 and 130 as seen in FIG. 5. The slot 124 has a generally U-shaped cross-sectional configuration (FIG. 6), the width and depth thereof being substantially equal in dimension at the termination of slot 124 at wall portion 104 and the radius of the curvature being about one half that dimension. However, the bottom portion 134 of slot 124 extends angularly and downwardly, as seen in FIGS. 4 and 6, away from generally circular bottom surface 136 in which slots 124, 126, 128 and 130 are formed. In this manner, bottom portion 134 of slot 124 is disposed at an angle from the central axis of chamber 102; in the preferred form the angle is about 45°. The slots or grooves 124, 126, 128, and 130 enable the carbonated liquid to flow around the lower end of the ball 100 into a relatively large area 137 of the chamber 102. As the liquid flows upwardly through chamber 102, the flow area is diminished to a minimum at a horizontal diametral plane of the ball 100. The diametral plane at which the flow area is restricted to a minimum extends perpendicular to the vertical central axis of the chamber 102.

As the carbonated liquid continues to flow upwardly around the ball 100, the flow area increases to a maximum at 138 between the uppermost portion of the ball 100 and the lower most portion of the ball 98. Continued upward flow of the liquid results in a passing through a portion of the chamber 102 having a continuously decreasing flow area which reaches a minimum at the horizontal diametral plane of the ball 98. Continued upward flow of the carbonated liquid causes it to enter an increasing flow area portion 139 of the chamber 102. At the uppermost end of the chamber 102 are formed a plurality of radially extending slots or grooves 144, 146 and 148 having the same cross-sectional configuration as grooves 124, 126, 128, and 130. Although only three grooves 144, 146, and 148 are shown in FIG. 4, it should be understood that there are four grooves disposed in the same spatial arrangement as illustrated in FIG. 5 for the grooves 124, 126, 128, and 130. After the carbonated liquid flows into the enlarged flow area 139 at the upper end of the chamber 102, it enters the main flow passage 78 leading to the dispenser valve 70.

Unlike U.S. Ser. No. 484,122, balls 98 and 100 are of unequal dimension and are not free to shift either vertically or horizontally within chamber 102. The diameter of lower ball 100 is slightly less than the diameter of upper ball 98 in order to provide a larger initial flow area upon entrance into foam inhibiting device 94. For example in the preferred form, lower ball 100 has a diameter of 0.375 of an inch (0.953 cm.) while the upper ball 98 has a diameter of 0.380 of an inch (0.965 cm.) providing a diametral ratio of the upper to lower balls of about 1.013. The balls are fixed in both the vertical and horizontal directions within chamber 102 by disposing the balls in contact with one another and by securely placing the upper portion of ball 98 in circular seat 133 and the lower portion of ball 100 in circular seat 135.

In U.S. Ser. No. 484,122, it was found that if certain clearances were exceeded balls 98 and 100 tended to oscillate or vibrate and carbonated liquid flowed excessively, resulting in the formation of substantial foam in a glass which received the liquid. It was also found that the balls could not be too large for chamber 102 because the flow was excessively restricted resulting in long periods of time to fill the glass and because unacceptable amounts of foam were formed.

These problems are hereby avoided by disposing the balls in horizontally and vertically fixed positions between the seats 133 and 135 and by providing the necessary clearances between the balls and chamber 102. Thus, the flow area at the horizontal diametral plane of ball 100 will be greater than that at the horizontal diametral plane of upper ball 98 because of the difference in diameters discussed above. In the preferred form, chamber 102 has an inner diameter of 0.388 of an inch (0.986 cm.) providing an annular radial clearance of about 0.0065 of an inch (0.0165 cm.) on lower ball 100 and about 0.004 of an inch (0.0102 cm.) on upper ball 98; thus, the ratio of lower radial clearance to upper radial clearance is 1.625. It is also preferred to construct the foam inhibiting device 94 with the upper slots 144, 146, and 148 having a greater dimensional size than the lower slots 124, 126, 128, and 130. Thus, in the preferred form the lower slots had a width and depth of 0.093 of an inch (0.236 cm.) at the wall portion 104 while the upper slot had a width and depth of 0.125 of an inch (0.318 cm.) at the wall portion 104, resulting in an upper to lower slot dimensional ratio of about 1.34. The above dimensional ratios show the gradual progression in relative size in the direction of flow from the smaller, lower slots and ball to the larger, upper slots and ball.

Figure 8:
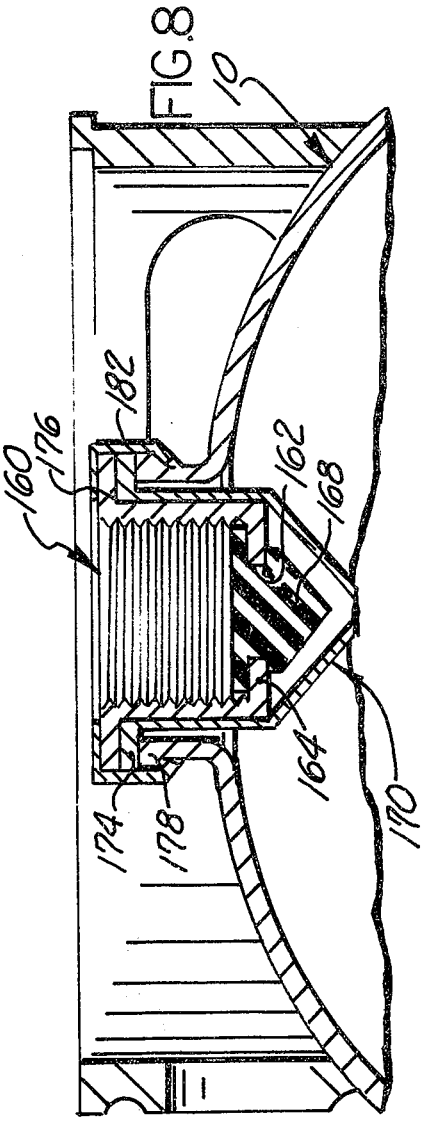
FIG. 8 is a sectional view illustrating an arrangement for sealing of the tank of FIG. 7 prior to mounting of the dispensing valve assembly on the tank.
Figure 7:
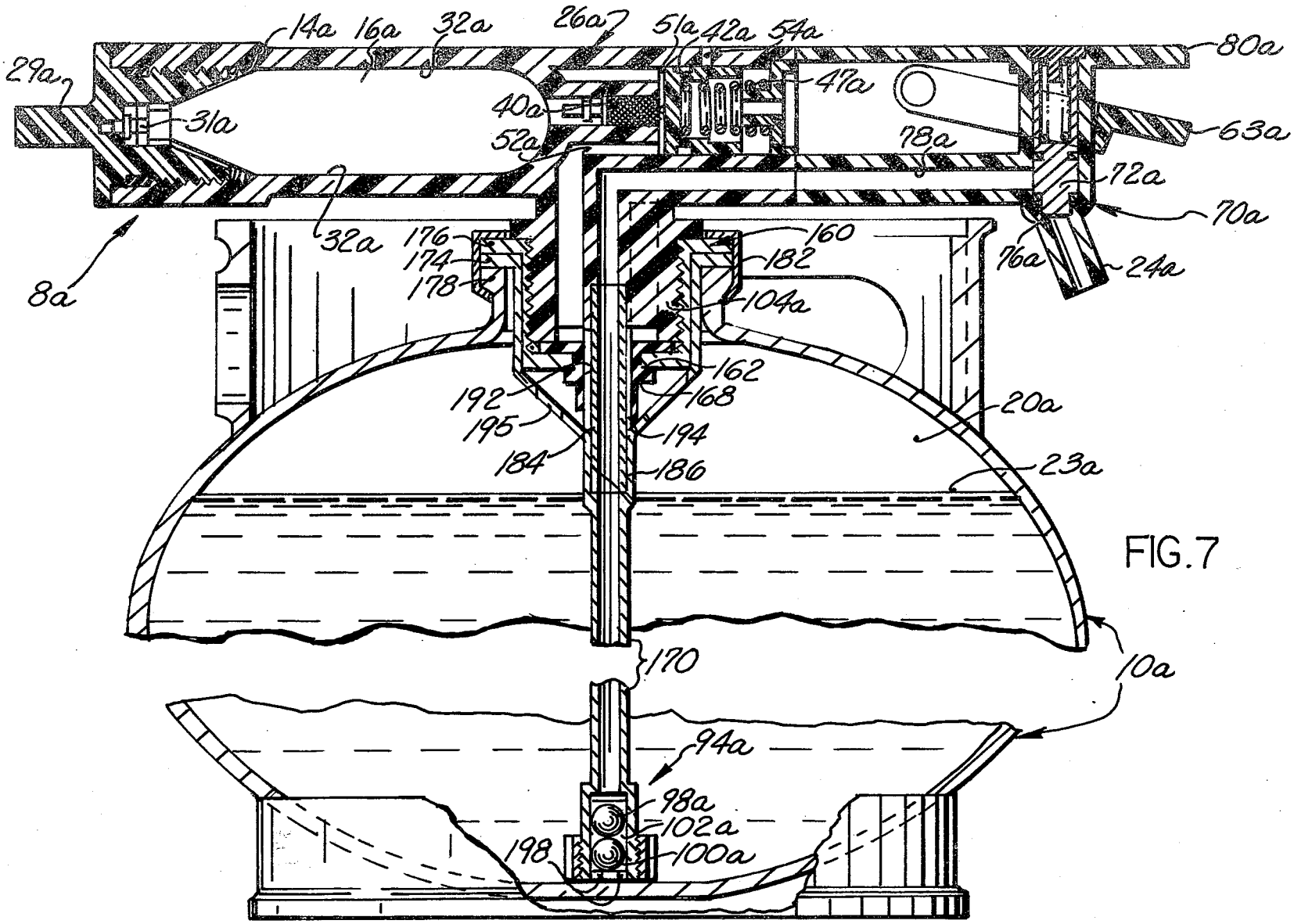
FIG. 7 is a sectional view of a dispenser valve assembly forming a second embodiment of the invention, the dispenser valve assembly being illustrated in association with a tank of carbonated liquid.

A second embodiment of the invention is illustrated in FIG. 7. This embodiment of the invention is generally similar to the embodiment of the invention illustrated in FIGS. 1 through 6. Therefore, similar numerals will be used to indentify similar components, the suffix letter *a* being associated with the embodiment of the invention illustrated in FIG. 7 to avoid confusion. In the embodiment of the invention illustrated in FIG. 7, a dispenser valve assembly 8*a* is associated with a plastic or metallic tank or container 10*a*. The tank or container 10*a* holds a carbonated liquid. The tank or container is originally supplied with the upper end of the tank blocked by an internally threaded end cap 160 (see FIG. 8) having a central opening 162 and a circular bottom wall 164. The opening 162 is sealed by a rubber grommet 168. An enlarged upper end portion of a tubular member 170 is provided with an annular flange 174 which is disposed between a flange 176 formed on the end cap 160 and an upper end portion 178 of the container 10*a*. The end cap and flanged end portion of the tubular member 170 are held in place by suitable clamp 182.

When the dispenser valve assembly 8*a* is to be mounted on the container 10*a*, a metal piercing tube 184 having a pointed end 186 is pressed into the rubber grommet 168. After the metal piercing tube has passed approximately half way through the rubber grommet 168, external threads on a downwardly extending wall 104*a* of the valve assembly 8*a* move into engagement with internal threads on the end cap 160. To continue the downward movement of the metal piercing tube 184 through the grommet 168, it is necessary to rotate the dispenser valve assembly 8*a*. As the dispenser valve assembly 8*a* is rotated, the downwardly projecting annular end wall 104*a* moves into sealing engagement with the upper end portion of the grommet 168. As this is occurring, the metal piercing tube 184 enters into the downwardly projecting tube 170 in the manner shown in FIG. 7.

In accordance with a feature of the embodiment of the invention shown in FIG. 7, a foam inhibiting device 94*a* is mounted on the lower end portion of the tube 170. The foam inhibiting device 94*a* includes a pair of balls 98*a* and 100*a* which are disposed in a generally cylindrical chamber 102*a* of the same construction as the chamber 102 of FIGS. 1 and 4. The fixed balls 98*a* and 100*a* vary the flow area through the chamber 102*a* in the manner previously explained in conjunction with the embodiment of the invention illustrated in FIGS. 1–6.

A carbon dioxide cartridge 16*a* is disposed in a chamber 14*a*. The carbon dioxide cartridge 16*a* is pierced by point 31*a* on a plug 29*a* to enable carbon dioxide to flow along axially clearance 32*a* formed between the wall of the dispenser body 26*a* and the cartridge 16*a*.

If the pressure in the container 10*a* falls below a predetermined minimum pressure, a spring 47*a* is effected to move a piston 42*a* toward the left (as viewed in FIG. 7) to open a tire valve 40*a*. Opening the tire valve 40*a* enables carbon dioxide to flow through the tire valve to a chamber 51*a*. The chamber 51*a* is connected by passage 52*a* to a longitudinally extending slot 192 formed in a cylindrical tube 194 which circumscribes the piercing tube 184. The slot 192 extends through the grommet 168 to enable the carbon dioxide to enter the interior 20*a* of the container 10*a* through an opening 195. A relief port 54*a* is provided to vent the interior of the container 10*a* to atmosphere in the event of formation of excessive pressures in the tank. When the carbonated liquid is to be dispensed from the container 10*a*, the main dispenser valve 70*a* is opened by pivoting a handle 63*a* upwardly toward a fixed member 80*a*. The pivotally mounted handle 63*a* is connected with a valve member 72*a* so that upward movement of the handle 63*a* raises the valve member 72*a* away from a valve seat 76*a* to enable liquid to flow through a spout 24*a* into a suitable glass or other receptacle.

Upon opening of the valve 72*a*, the carbonated liquid in the container 10*a* enters the foam inhibiting device 94*a* through a plurality of openings 198 formed in the bottom wall of the chamber 102*a*. The openings 198 are connected with radially extending passages, similar to the passages 124, 126, 128, and 130 of FIG. 5. The fixed balls 98*a* and 100*a* vary the flow area through which the carbonated liquid passes from a relatively large area to a relatively small area at a horizontal diametral plane of the ball 100*a* and then to a relatively large area between the balls and back to a relatively small area at the horizontal diametral plane of the upper ball 98*a*. The flow area then enlarges as the liquid flows into the tube 170. The liquid then flows upwardly through the tube 170 to the cylindrical piercing tube 184. The carbonated liquid then passes from the piercing tube 184 into a main flow passage 78*a* formed in the body of the dispensing valve assembly.

In view of the foregoing description, it can be seen that the dispensing valve assemblies 8 and 8*a* both include foam inhibiting devices 94 and 94*a*. The foam inhibiting devices prevent the formation of excessive amounts of foam in a glass upon opening of the main dispensing valve. Although the balls 98 and 100 have been shown as separate members, it is contemplated that they could be joined together at the upper portion of the lower ball and the lower portion of the upper ball to form a single member. Of course, the extent to which the balls were joined together would not be so great as to destroy the enlarged flow area in the middle portion of the chamber 102.

The above-described invention not only safely dispenses carbonated liquids but also instantly carbonates liquids which were not previously carbonated; for example, the invention will carbonate still wines into sparkling, crackling, or carbonated wines tasting similar to champagne; real, imitation, or near beer or wine in powdered form, after mixing with water; or any beverage syrup or powder, after mixing with water. Once the liquid to be carbonated has been prepared and placed in the container, the dispenser is preset to allow only the desired amount of $CO_2$ to enter the container. The desired level of carbonation is achieved by shaking the container to charge the liquid with $CO_2$ from the available $CO_2$ above the liquid, which is controlled by the above-described valve arrangement and safety features. Unlike some prior art devices which charged the liquid with 900 p.s.i. $CO_2$, the present device avoids any explosion danger by reducing the $CO_2$ pressure to a safe level, e.g., 30 p.s.i., for continuous carbonation, even to the last portion of liquid to leave the container. When the container is initially filled with the liquid to be carbonated, the $CO_2$ in the 3 to 4 ounce space above the liquid is mixed with the liquid by shaking the container to cover the $CO_2$ with liquid drops, forming a carbonated liquid with very fine bubbles that has been only achievable heretofore with a mechanical carbonator. For example, a two volume carbonated liquid (two volumes of $CO_2$ to one volume of liquid) can be achieved by shaking the container with the present dispenser about one half to one minute; stronger levels of carbonation require correspondingly longer times. However, the liquid cannot be over carbonated because the dispenser reduces the $CO_2$ pressure to a safe level for continuous carbonation at an even level while the dispenser is attached to the container. Even when the dispenser is removed, any remaining carbonated liquid may be preserved by recapping the container. Thus, the present invention has the advantage of eliminating the carrying of heavy cans and returnable or disposable containers because only a powder or syrup has to be purchased, saving bottling costs and eliminating the high cost of bottling and transporting the water that forms most of the volume of any beverage.

What is claimed is:

1. In a carbonated liquid dispenser having means for defining a flow path for the carbonated liquid from a container thereof to an outlet opening, a valve means for selectively opening and closing the outlet and a foam inhibiting means in the flow path upstream from said valve means for defining a passage portion of varying cross section over a finite distance within the path for retarding foaming of the carbonated liquid over said flow path, said flow inhibiting means including means for reducing the flow area along the path from a first relatively large area to a second relatively small area, for increasing the flow area along the path from the second relatively small area to a third relatively large area, for reducing the flow area along the path from the third relatively large area to a fourth relatively small area, and for increasing the flow area along the path from the fourth relatively small area to a fifth relatively large area, the improvement wherein the finite distance of said flow path is defined by a member having a chamber, said foam inhibiting means comprising first and second ball members of unequal diameter located in said chamber, chamber inlet means defining a seat for said first ball member and defining with said first ball member a passage therebetween for flow of fluid into said first relatively large area of said chamber, chamber outlet means defining a seat for said second ball member and defining with said second ball member a passage therebetween for flow of fluid from said fifth relatively large area of said chamber toward said valve, said first and second ball members being positioned in said seats to prevent both horizontal and vertical movement in said chamber while fluid flows therethrough.

2. In a carbonated liquid dispenser as defined in claim 1 wherein said chamber inlet means and said chamber outlet means include slots extending laterally of said chamber for fluid flow therethrough and said slots being open for said fluid flow even when said respective balls are in contact with said seats.

3. In a carbonated liquid dispenser as defined in claim 2 wherein said second ball has a diameter greater than said first ball.

4. In a carbonated liquid dispenser as defined in claim 3 wherein the diametral ratio of said second ball to said first ball is about 1.013 and the radial clearance ratio of the clearance of said first ball to said second ball is about 1.625.

5. In a carbonated liquid dispenser as defined in claim 3 wherein said slots are generally U-shaped and have a bottom portion which is disposed at an acute angle from a central axis of said chamber and extends away from said seats.

6. In a carbonated liquid dispenser as defined in claim 5 wherein said angle is about 45°.

7. In a carbonated liquid dispenser as defined in claim 5 wherein said slots associated with said second ball are larger than said slots associated with said first ball.

8. In a carbonated liquid dispenser as defined in claim 7 wherein the width ratio of said slots associated with said second ball to said slots associated with said first ball is about 1.34.

9. In a carbonated liquid dispenser as defined in claim 8 wherein the radial clearance between said first ball and said chamber is about 0.0065 of an inch, the radial clearance between said second ball and said chamber is about 0.004 of an inch, said second ball is about 0.380 of an inch in diameter with its associated slots being about 0.125 of an inch in width, and said first ball is about 0.375 of an inch in diameter with its associated slots being about 0.93 of an inch in width.

10. In a carbonated liquid dispenser as defined in claim 2 wherein said dispenser includes a housing, chamber means in said housing for receiving a carbon dioxide cartridge, passage means in said housing for conducting carbon dioxide under pressure from said chamber means to the interior of the container, second valve means in said housing for controlling the flow of carbon dioxide through said passage means, said second valve means being operable between a closed condition blocking the flow of carbon dioxide through said passage means and an open condition enabling carbon dioxide to flow through said passage means to the container, piston means disposed in said housing and movable between an active position in which said piston means is effective to operate said second valve means to the open condition enabling carbon dioxide to flow through said passage means to the container and an inactive condition in which said second valve means is closed blocking the flow of carbon dioxide through said passage means, biasing means for urging said piston means toward the active position, and said piston means including surface means exposed to the fluid pressure in the container for urging said piston means toward the inactive position against the influence of said biasing means.

* * * * *